US006648631B2

(12) United States Patent
Wright et al.

(10) Patent No.: US 6,648,631 B2
(45) **Date of Patent: *Nov. 18, 2003**

(54) DEEP DRAWN CANDLE CAN WITH FORMED SAFETY BOTTOM

(75) Inventors: Chet Wright, Rockford, IL (US); Walter P. Pietruch, Belvidere, IL (US); Richard L. Peterson, Roscoe, IL (US)

(73) Assignee: J. L. Clark, Inc., Rockford, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/351,899

(22) Filed: Jan. 27, 2003

(65) Prior Publication Data

US 2003/0113681 A1 Jun. 19, 2003

Related U.S. Application Data

(62) Division of application No. 10/115,191, filed on Apr. 2, 2002, now Pat. No. 6,543,268, which is a continuation of application No. 09/749,617, filed on Dec. 27, 2000, now abandoned.

(60) Provisional application No. 60/174,210, filed on Jan. 3, 2000.

(51) Int. Cl.[7] ..... F21V 35/00

(52) U.S. Cl. ..... 431/291; 431/289

(58) Field of Search ..... 431/291, 289, 431/320, 321, 35; 126/43, 45; 220/212, 796; 422/125

(56) References Cited

U.S. PATENT DOCUMENTS

| | | | |
|---|---|---|---|
| 226,347 | A | 4/1880 | Pecor et al. |
| 2,001,312 | A | 5/1935 | O'Connell |
| 2,028,798 | A | 1/1936 | Murch |
| 2,075,847 | A | 4/1937 | Hothersall |
| 2,413,093 | A | 12/1946 | Warth et al. |
| 3,690,507 | A | 9/1972 | Gailus |
| 3,796,085 | A | 3/1974 | Fisher et al. |
| 3,884,383 | A | 5/1975 | Burchietal |
| 3,905,507 | A | 9/1975 | Lyu |
| 3,912,109 | A | 10/1975 | Essex, Jr. et al. |
| 4,010,867 | A | 3/1977 | Jones |
| 4,121,448 | A | 10/1978 | Censuales |
| 4,181,239 | A | 1/1980 | Heiremans et al. |
| 4,199,622 | A | 4/1980 | Kokumai et al. |
| 5,060,818 | A | 10/1991 | Doi et al. |
| 5,842,850 | A | 12/1998 | Pappas |
| 6,036,042 | A | 3/2000 | Pietruch et al. |
| 6,062,847 | A | 5/2000 | Pappas |
| 6,155,451 | A | 12/2000 | Pietruch et al. |
| 6,398,544 | B2 | 6/2002 | Wright et al. |
| 6,543,268 | B2 * | 4/2003 | Wright et al. ..... 431/291 |

FOREIGN PATENT DOCUMENTS

| | | |
|---|---|---|
| DE | 2440068 | 3/1976 |
| DE | 2706103 | 8/1978 |

OTHER PUBLICATIONS

U.S. patent application Ser. No. 09/749,617, Wright et al., filed Oct. 2001.

* cited by examiner

*Primary Examiner*—James C. Yeung
(74) *Attorney, Agent, or Firm*—Leydig, Voit & Mayer, Ltd.

(57) ABSTRACT

A seamless candle can is formed in a blank and draw operation, and includes a complex bottom structure formed at the end of the drawing process. The bottom structure includes an annular base which occupies less than 30% of the area of the bottom surface, and a raised central platform for supporting a wick structure. The platform is raised at least 0.25 inch above the container bottom. A gently sloping surface joins the annular support ring to the central platform. The distance by which the platform is raised and the angle of the connecting surface are adapted to prevent overstretching of the material during the formation of the bottom, so as to prevent the formation of holes in the seamless can which would cause leaks. The central platform serves to support a wick sustainer at a location above the bottom of the can in order to reduce the possibility of flash-over.

10 Claims, 10 Drawing Sheets

DEEP DRAWN CANDLE CAN WITH FORMED SAFETY BOTTOM

CROSS-REFERENCE TO RELATED PATENT APPLICATIONS

This patent application is a divisional of U.S. patent application Ser. No. 10/115,191, filed on Apr. 2, 2002, U.S. Pat. No. 6,543,268, which is a continuation of U.S. patent application Ser. No. 09/749,617, filed Dec. 27, 2000, abandoned which claims the benefit of U.S. provisional patent application No. 60/174,210, filed Jan. 3, 2000.

FIELD OF THE INVENTION

This invention relates to drawn metal containers, and more particularly to containers adapted for use as candle cans.

BACKGROUND OF THE INVENTION

Candles are often merchandised in decorative containers to present a package attractive to the purchasing consumer. A number of factors impact the design of a successful can for a candle, and they cover a range of factors including economy and ease of manufactureability, decorativeness, ability to reliably contain the molten wax, and overall safety, as examples.

In recent years that has been an explosive growth in the use of scented candles in homes and business. In home environments the aromas released by the scented candle wax burned by candle wicks frequently are selected for the seasonal ambiance their burning evokes. Lilac in the spring, rose in the summer, pine in the winter or whatever fragrance suits ones fancy. In business settings there are those that believe the aromas selected have therapeutic values with some individuals believing that citrus aroma heightens mental acuity. Most everyone is familiar with glass candle holders now in common use. Even if the outsides of the glass are decoratively finished, when the candle wax is used up the transparent nature of the glass reveals the burned out condition of the candle which is not attractive. Enter highly decorative finished metal cans that look beautiful at all stages of their life. Even when empty they are considered by many to be worthy of collection. The downside of using metal cans to accommodate burning candles is well known and derives from the fact that the thermally conductive nature of metal frequently allows transmission of harmful quantities of heat from not only the flame but from the heated and liquefied candle wax to pass through the can base to a support surface which may be damaged by the heat.

Candle flash-over is also a danger. As is known, flash-over can occur when the pool of wax in the bottom of a candle can becomes relatively shallow, the wick burns down to approach the shallow pool, the pool becomes hotter than normal, and ultimately may reach a self sustain combustion temperature, at which temperature the wax will burn without a need for a wick. The candle can then reach temperatures significantly in excess of 600° F. and thereby present a significant fire hazard.

The engine that drives competition is the seemingly never ending effort to discover simpler and simpler manufacturing procedures that reduce unit cost and enhance competitive pricing. It is in response to this quest for simplification that the subject invention provides an answer.

Pappas U.S. Pat. No. 5,842,850 describes various approaches to preventing flash-over. These approaches deal primarily with keeping the wick, i.e. the source of candle ignition, sufficiently above the floor of the candle container which makes the flame go out before the fuel exceeds its flash point temperature. The '850 patent typically employs a candlewick sustainer wherein the wick is held in a bore formed in the sustainer. The bore which contains the wick is centrally disposed in a vertical column that is supported by a base made impervious to candle fuel which thereby ensures that no candle fuel can reach the wick through the base that supports the bore containing the candle wick. Because the wick must be in contact with the liquefied wax it burns, it follows that the height of the sustainer column determines when the wick will lose its supply of fuel. The '850 patent indicates that the top end of the column extends above the floor of the candle container an amount sufficient to prevent flash-over. In several embodiments it includes a centrally disposed pedestal upon which is mounted the afore described candlewick sustainer. The '850 patent notes that where the candle container is of stamped metal the pedestal can be stamped into the container during manufacture, but provides no details on how that is to be accomplished.

The subject invention distinguishes over the '850 patent in a number of novel and beneficial ways, most significantly in the provision of a seamless deep drawn metal can with a unique stamp formed bottom structure that results in a container having no holes or perforations except for an open top. The stamped bottom uniquely elevates a candle wick holder which functions to deprive the candle wick of burnable fuel and possible flash-over, starving the wick of fuel to prevent additional capillary action through the wick, and isolating heated liquefied fuel away from the center and toward the periphery. The unique bottom structure also elevates the burning wick in such a manner that there is provided an insulating air space centrally disposed beneath the burning wick. The unique bottom structure also provides an annular surface ring that may engage any surface upon which the candle can is placed further ensuring a minimal transfer of heat through the bottom of the candle can which might scorch and mar the surface.

BRIEF SUMMARY OF THE INVENTION

In view of the foregoing, it is a general aim of the present invention to provide a completely new form of candle can, based on existing deep drawing technology, but which provides a specially profiled can bottom having the unique features of being highly manufactureable yet providing a means for separating a candle wick from the bottom of the candle can.

It is an object to provide a candle can which is economical to mass produce, yet includes a highly effective safety bottom.

According to a particular aspect of the invention, it is an object to provide a safety bottom for a candle can which substantially reduces the area of contact between the can with its supporting surface, positions the contact area remote from the flame, and provides a wick platform adapted to minimize the possibility of flash-over.

Thus it is a feature to provide a candle can bottom structure which can be readily stamped during the drawing process for forming a single piece can, but without the danger of so-overstretching the material of the bottom as to create the possibility of pinholes, leaks or tears.

It is a feature of one form of the invention that the specially formed candle can has a bottom configuration which has a relatively small area annular support surface ring at its base, so that when the base rests on a surface, contact with that surface is limited to the annular support surface ring, keeping most of the can bottom out of contact with the supporting surface.

It is a further feature that the annular ring is positioned in a portion of the can in which wax is least likely to melt, with the wick support being configured to prevent flash-over and limit melting of the thicker portion of the wax at the outer periphery of the can. In that regard, the peripheral base remains at a somewhat lower temperature, so as to avoid scorching the table or other supporting surface.

These and other aims, objectives, and features of the invention will become more apparent from the following detailed description when taken in conjunction with the accompanying drawings, in which:

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
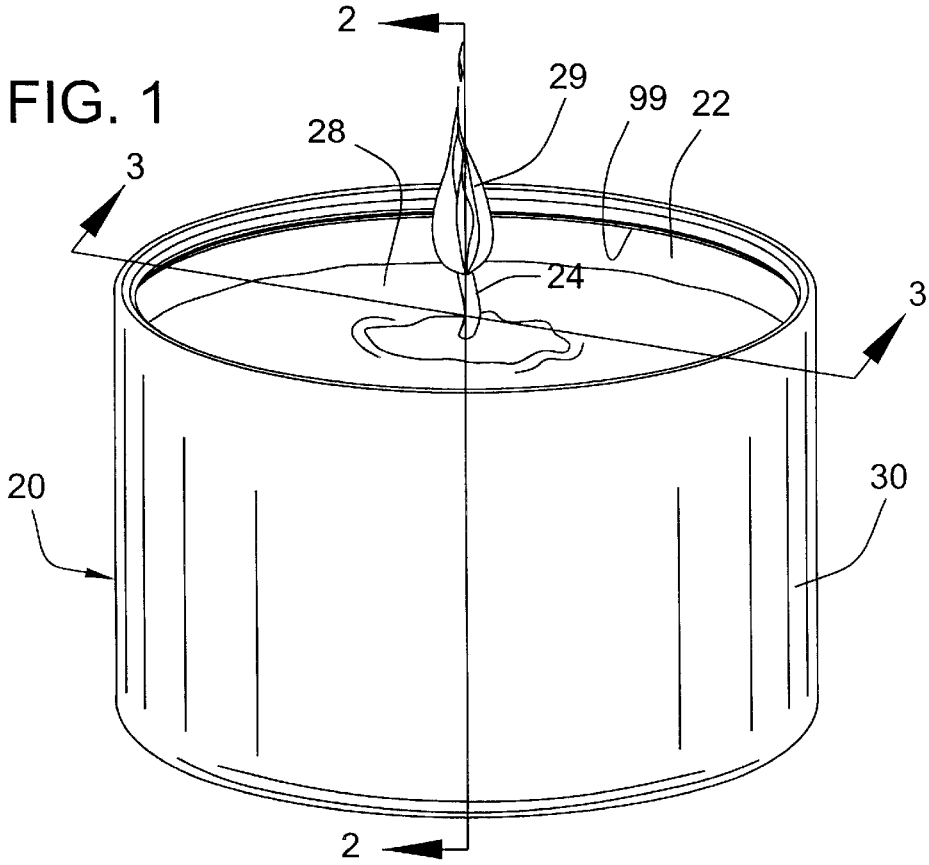
FIG. 1 is a perspective view of a candle can exemplifying the present invention.
Figure 2:
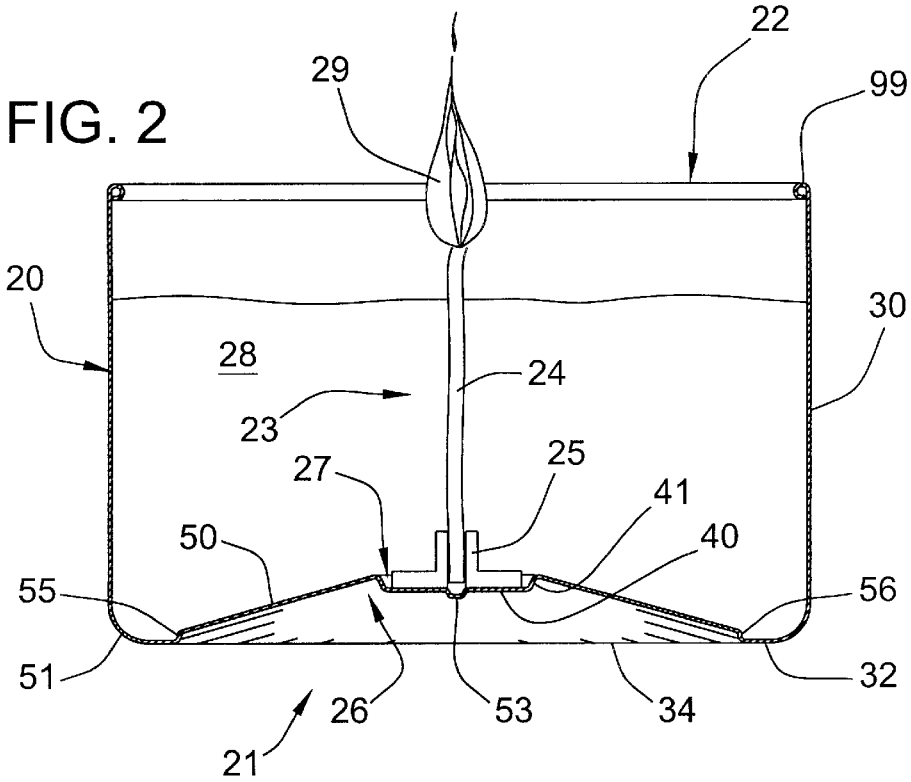
FIG. 2 is a cross-sectional view of the can of FIG. 1 showing the specially formed bottom, wick seat and wick sustainer.

Turning now to the drawings, and referring to FIGS. 1 and 2, there is shown a candle can constructed in accordance with the teachings of the present invention. A seamless metal container 20 having a generally vertical side wall 30 is formed with a special bottom structure 21 to provide a drawn and stamped container having no holes or perforations except for an open top 22. The can has a wick structure 23 which includes a wick 24 and a wick holder 25. After placing the wick holder 25 on a cone shaped dome 26 which includes a dish shaped locating structure shown herein as seat 27, the can is filled with a quantity of molten wax 28, or other liquid fuel, which subsequently solidifies. When the wick is lighted, wax in the pool around the wick melts and is carried up the wick by capillary action to feed the flame 29. When the wick burns down to the top of the wick holder 25, the flame extinguishes, as is known in the art.

Turning to the structure of the can in greater detail, it will be seen that it is a deep drawn cylindrical structure having a cylindrical upstanding sidewall 30 terminating in a complex bottom wall structure 21. Deep drawing the cylinder creates a candle can having sufficient height (as compared to the diameter) to adequately serve as a candle can. When used herein, "deep drawn" means a cylinder whose height is at least 50% of its diameter. In the preferred implementation 60% is achieved, and in a particular example, a can of 2.5 inches diameter is 1.5 inches in height.

The bottom structure 21 is configured, in accordance with the present invention, to include an annular base 32 defined at about the outer periphery of the can, and merging into the sidewall 30. The remainder of the bottom is raised above the plane 34 defined by the annular base 32. The word "base" in the present application is used to define the peripheral ring 32, typically although not necessarily continuous, which typically forms the lowermost part of the bottom. However, in some cases it may be desirable to even further limit contact with the underlying surface. In that case, small dimples or feet 32*a* (see FIG. 3) can be formed in the bottom of the peripheral ring 32, or otherwise in the can. Even in that case, however, the annular ring 32 will be referred as the "base", even if it is not the actual structure which rests on a supporting surface; it remains the base of the basic bottom configuration.

According to one aspect of the invention, the bottom structure 21 is provided with a wick supporting cone shaped dome 26 onto which a wick assembly can be placed, for example, a wick holder 25 containing a wick 24. When a wick holder 25 is used, the wick supporting cone shaped dome 26 is formed to include a seat 27 preferably circular and configured to the size of the sustainer bottom. The term "wick holder" and "sustainer" will be used to mean the same thing hereafter. In the embodiment illustrated, the seat 27 is formed as a dished circular depression, preferably located at the center of the bottom 21, and having a seat supporting surface 40 surrounded by a cylindrical short and generally upstanding sidewall 41. In other embodiments, the seat can be flat, comprising a flat plateau at the apex of the dome. Other forms of wick support can be utilized, and may require a different shape for the seat 27. In the illustrated embodiment the sidewall. 41 is conveniently but not necessarily inclined slightly at an angle (from the vertical) as illustrated in FIG. 2 in order to ease the demands on the material during the stage of the processing used to form the bottom.

As is understood by those skilled in the candle art, if the flame 29 continues to burn after the pool of molten wax in the bottom of the can becomes too shallow, the temperature of the wax will increase, and may reach the flash-over point. To that end, those skilled in the art have attempted to extinguish the flame when it is about ½ inch or slightly more above the bottom of the container. Wick holders that allow the flame to be snuffed usually take on the structural appearance shown in FIG. 2 but having a relatively long (e.g., ½ inch) plugged sustainer supporting the wick. It has also been suggested to use a platform directly underlying the sustainer, with the platform walls falling away sharply to raise the bottom of the sustainer above the pool of wax. When the base of the sustainer is no longer in the pool, wax is unable to flow up the wick by capillary action, and the flame will extinguish.

In accordance with the present invention, a wick supporting cone shaped dome is formed in the bottom of a deep drawn container in the same operation which draws the container, and is shaped to minimize the possibility of overstretching the metal, to avoid tears or other undesirable perforations in the material of the bottom.

Figure 3:
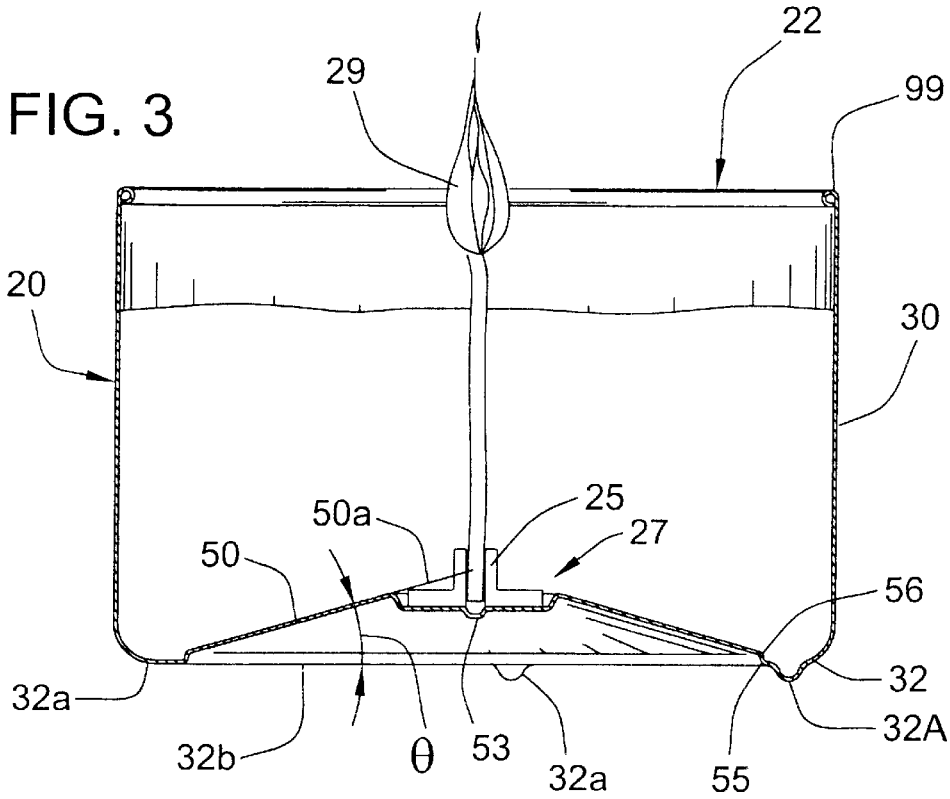
FIG. 3 is a partial sectional view illustrating projections from the candle can base serving as feet, and also defining certain geometrical relationships of the can structure.

In practicing certain aspects of the invention, it has been found important to provide a container bottom in which a substantial percentage of the bottom structure is out of contact with the planar surface which supports the can. In the embodiment of FIG. 2, the annular base serves as the can support and contacts the surface on which the can is placed. Alternatively, as illustrated in FIG. 3, protrusions 32*a* formed in the bottom structure, extending to a plane lower than the base plane, may serve as the can support. In either case the can support which is adapted to contact the surface on which the can is placed, should be minimized, typically to occupy no more than about 30% of the total bottom area and most preferably even less. In the preferred example of a 2.5 inch diameter can, the peripheral ring is only about 0.19 inches wide, such that the 0.38 inch total (2 sides) in a 2.5 inch can amounts to about 15% on a diameter basis and about 28% on an area basis. Considering that the drawing operation will preferably have a smooth curve 51 merging the sidewalls into the annular support ring, it will be seen that substantially less than 30% of the bottom area will be in contact with the underlying surface. This minimizes heat transfer to the surface, while still providing a very stable support.

Of the approximately 70% of the area of the can (in the preferred embodiment) which is raised above the plane 34, typically the wick supporting cone shaped dome 26 will require a circular mounting area of about 0.50 inches diameter for placement of the conventional wick holder. Thus, FIG. 2 shows a dish shaped locating structure 27 which is slightly greater than 0.50 inches in diameter, centered on the bottom of the can, and raised, in the preferred embodiment of the 2.5 inch can, approximately 0.19 inches above the plane 34. The height of the seat and the height of the sustainer are coordinated to achieve the 0.50 inches or more height for the flame at the point of extinguishment. The sidewall 41 need be only about a 1/16 inch in height to provide a secure dish shaped seat 27 for the wick holder 25. A shallow dimple 53 in the center of a seat supporting surface 26 provides the ability to assure that the wick holder rests flat in its seat, even if the wick protrudes through an aperture in center of the wick holder. The wick holder 25 and wick 24 will thus be held reliably in position as wax is poured into the can to form the completed candle.

The sloped conical wall 50 which joins the cone shaped dome 26 to the annular support surface 32, in the preferred 2.5 inch diameter can, is formed at an angle of about 23 degrees. The angle between a plane 32*b* through the base structure (normally horizontal) and a line 50*a* defined by the angled wall 50 is identified in FIG. 3 as the angle θ. Preferably the angle θ is in the range between about 15 and 60 degrees, and most preferably in the range between about 15 and 45 degrees. Forming a very steep angle will allow the cone shaped dome 26 to be raised, but will require greater stretching of the material of the central portion of the blank, creating the possibility of perforating the underside. Forming the angled bottom wall at an angle of less than about 15 degrees achieves insufficient raising of the central region of the cone shaped dome requiring a wick holder with an unworkably long neck. We have found that using a material of about 0.009 in thickness, and forming the angle at about 23 degrees, for a 2.5 inch diameter can, provides sufficient material in the central portion of the blank to allow the formation of the complex shape by stretching of that material as the mating surfaces of the die are driven into contact at the end of the drawing operation.

Figure 4:
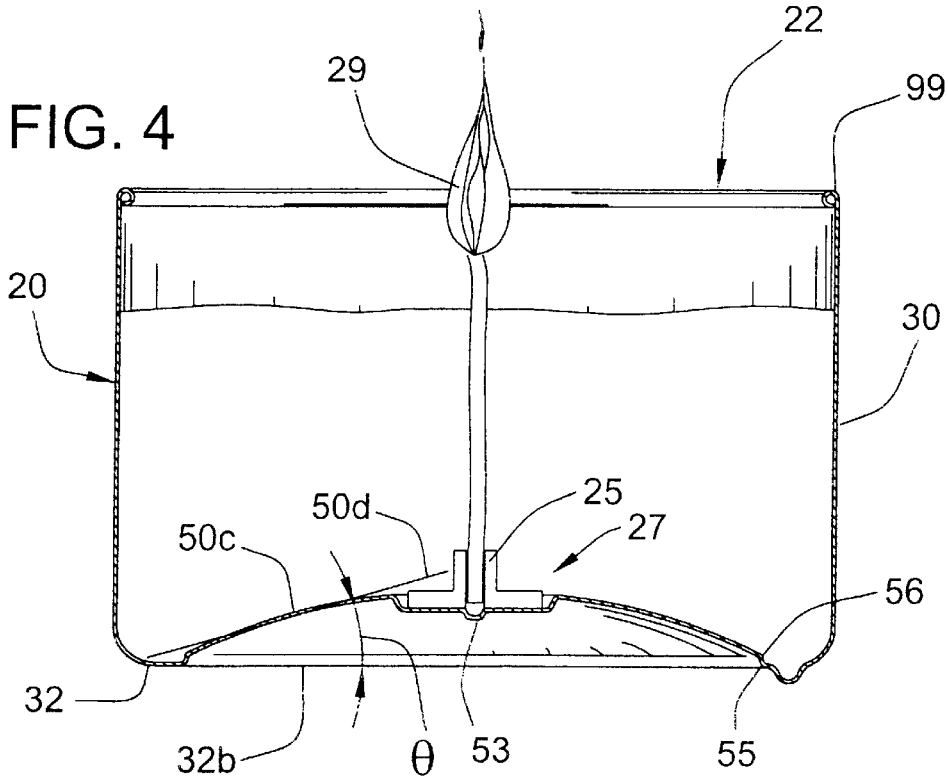
FIG. 4 is a cross-sectional elevation similar to FIG. 3 but illustrating a slightly crowned or domed configuration for the angled bottom wall.

In some cases it will also be useful to form the angled wall 50 as something other than a straight structure. For example, a slight crown might be introduced into the angled wall 50 as is shown in FIG. 4. In that case the angle θ is defined between the plane 32*b* through the annular ring 32 and the straight line 50*d* which passes through the crowned angled wall 50*c* as an approximate linear average of the curved configuration.

Figure 5:
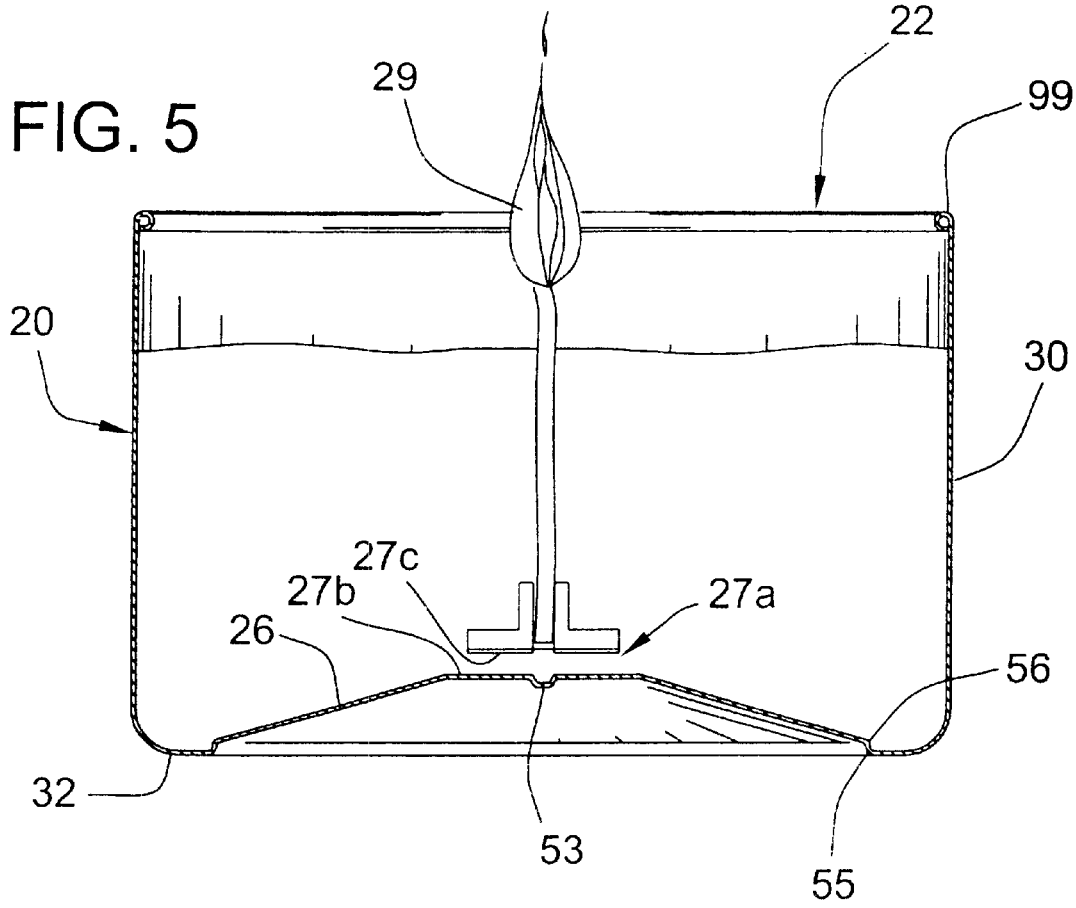
FIG. 5 is a cross-sectional elevation similar to FIG. 3, but illustrating a flat-topped domed configuration for the angled bottom wall.

In some cases, the candle maker will attach the wick support to its seat by means of adhesive, such as a hot melt adhesive. In those situations, it may be desirable to dispense with the depressed seat for the wick holder, and provide a seat 27*a* having a flat plateaued 27*b* at the apex of the dome 26 as illustrated in FIG. 5. The plateaued seat 27*a* can, if desired, include a depression 53 in the center thereof which serves to accommodate any stub of a wick which might protrude through the wick holder, and also serves as a centering target for positioning the wick holder. A thin area of glue 27*c* applied to the base of the wick holder secures the wick holder to the flat apex centered on the flat plateau 27*b*. The glue is preferably a hot melt adhesive which sets quickly and with sufficient strength to maintain the wick holder in place during the candle pouring operation.

Because the cans are used for decorative purposes, it is important to finish the top edge thereof. A typical finishing edge operation is curling of the upper lip inwardly, which presents a smooth and professional appearance and shields any sharp edges of the metal. Curling of the upper lip, however, in a can according to the present invention must be done in a special way which protects the complex underside of the can during subsequent curl forming operation. In curl forming the top, a die is forced down against the top while the can 20 is supported, and simply rolls the material over. If the walls is unsupported or not adequately captured, the wall "backs up" into an inadequately restrained area and actually distorts the bottom of the container.

In accordance with the invention, a sharp structural discontinuity 55 is formed in the bottom structure where the sloped conical wall 50 transitions into the annular support surface 32. This discontinuity 55 allows an expanding mandrel to positively grip the container and support the wall, preventing backup of the material during the curl forming operation. The discontinuity thus serves the function of a gripping discontinuity and includes a sharply bent but only slightly displaced annular notch 56 which forms a gripping surface used during such formation. The manner of manufacturing the candle can will be better described in connection with the sequential diagrams of FIGS. 6*a*–6*f*. For the moment, suffice it to say that when a mandrel is inserted into the can to provide support during a subsequent curl forming operation the mandrel is able to utilize the shape of the discontinuity 55 to grip the periphery of conical wall 50 and provide direct resistance along the line of the material to prevent the material from advancing when impacted by a curl forming die.

With all of that in view, the finished candle can 20, as shown in FIGS. 1–5, will be seen to have a generally vertical sidewall 30 which is deep drawn, the sidewall 30 extending between a closed bottom and an open top. The closed bottom has an annular surface 32 and a central wick supporting cone shaped dome 26. An angled bottom wall, which is at an acute angle to a plane through the base ring, joins the annular base to the wick supporting dish shaped locating structure. Preferably associated with the annular base is a discontinuity adapted to hold the shape of the bottom during the curling operation which forms the top. Preferably the wick supporting cone shaped dome includes a locating structure 27 of a size and shape sufficient to hold a conventional wick holder arrangement 25 in position during the candle pouring operation. The upper portion of the can has its edge 99 finished by inward curling to provide a neat and attractive appearance.

Figure 6A:
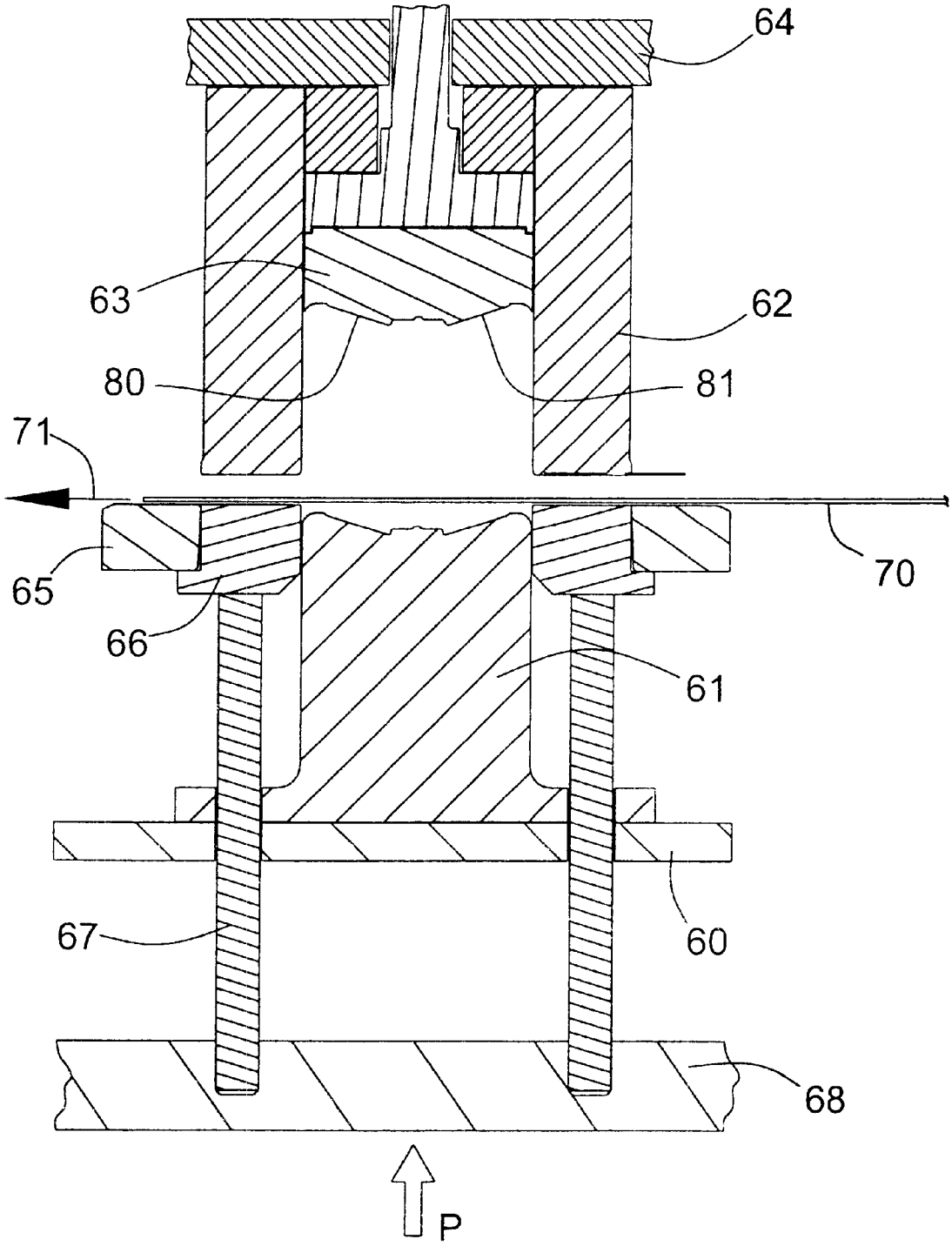
FIGS. 6*a*–6*f* are sequential views showing the formation of a candle can according to the preferred practice of the present invention.

Turning then to FIG. 6*a*, there are shown in somewhat schematic form the primary elements of a blank and draw tool set of the type which can be used in the practice of the present invention. It is emphasized that in the preferred form of the present invention, a conventional deep drawn can is modified with a special bottom configuration to provide a unique candle can structure. The economies of proceeding in that manner will be briefly mentioned. Because the standard tool set has been developed, engineered and well tested for forming the conventional can, the drawing aspect of the operation need not be altered. Nor does a complete set of tools need to be developed in order to form a candle can according to the present invention. Indeed, the basic elements of the tool set remain the same with the exception of the mating faces of a center block and form pad, which are specially adapted to form the particular unique bottom configuration. Thus, the dimensions relating to those devices that deal with the drawing of the cylindrical walls need not be altered, and only the facing surfaces which serve to form the metal of the can bottom at the conclusion of the drawing operation. Those mating faces are constructed to produce the shapes described in detail above, and it will be found that the standard drawing operation, terminating with the bottom forming operation at the end of the stroke, will produce the appropriate candle can.

It will be appreciated that the drawing operation which forms the cylindrical walls causes plastic flow in the metal in accordance with well known principles. However, there is no drawing or metal flow which occurs in the formation of the bottom. The mating surfaces of the contacting members simply shape the metal according to their configuration, and the process which is undergone by the metal during the course of that bottom forming is simply stretching of the metal. It will thus be appreciated that while there is significant metal working during the drawing process to form the sidewalls, the working of the metal during the formation of the bottom must be carefully controlled to prevent the overstretching of the metal which would tend to cause failures in the form of cracks or tears. It will be appreciated that any perforation in the bottom, when the candle burns down to the point that the liquid wax pool is in contact with the bottom, will tend to have wax flow out through the opening, potentially marring the surface on which the can rests. The reliable formation of the bottom will thus been seen to be a very important aspect of the formation of the candle can.

The requirements of the present invention to space a significant portion of the area of the can significantly above the supporting plane, and the requirement to form a flat supporting surface raised significantly above that floor, while at the same time avoiding pin holes, perforations or cracks in the metal, will be seen to be a significant advance in the art.

With that in view, and referring to FIG. 6*a*, the basic elements of the blank and draw tool set will now be described. FIG. 6*a* schematically shows a base or bolster 60 which supports a center block 61. The center block 61 is the mandrel about which a blank is drawn to form a can. A movable punch member 62 carries an upper form pad 63, both of which are supported on a member 64 which is the driving element of a conventional hydraulic punch press. The upper form pad 63 and the facing element of the center block 61 are configured at their mating surfaces to form the can bottom structure, as will be described below.

Figure 6B:
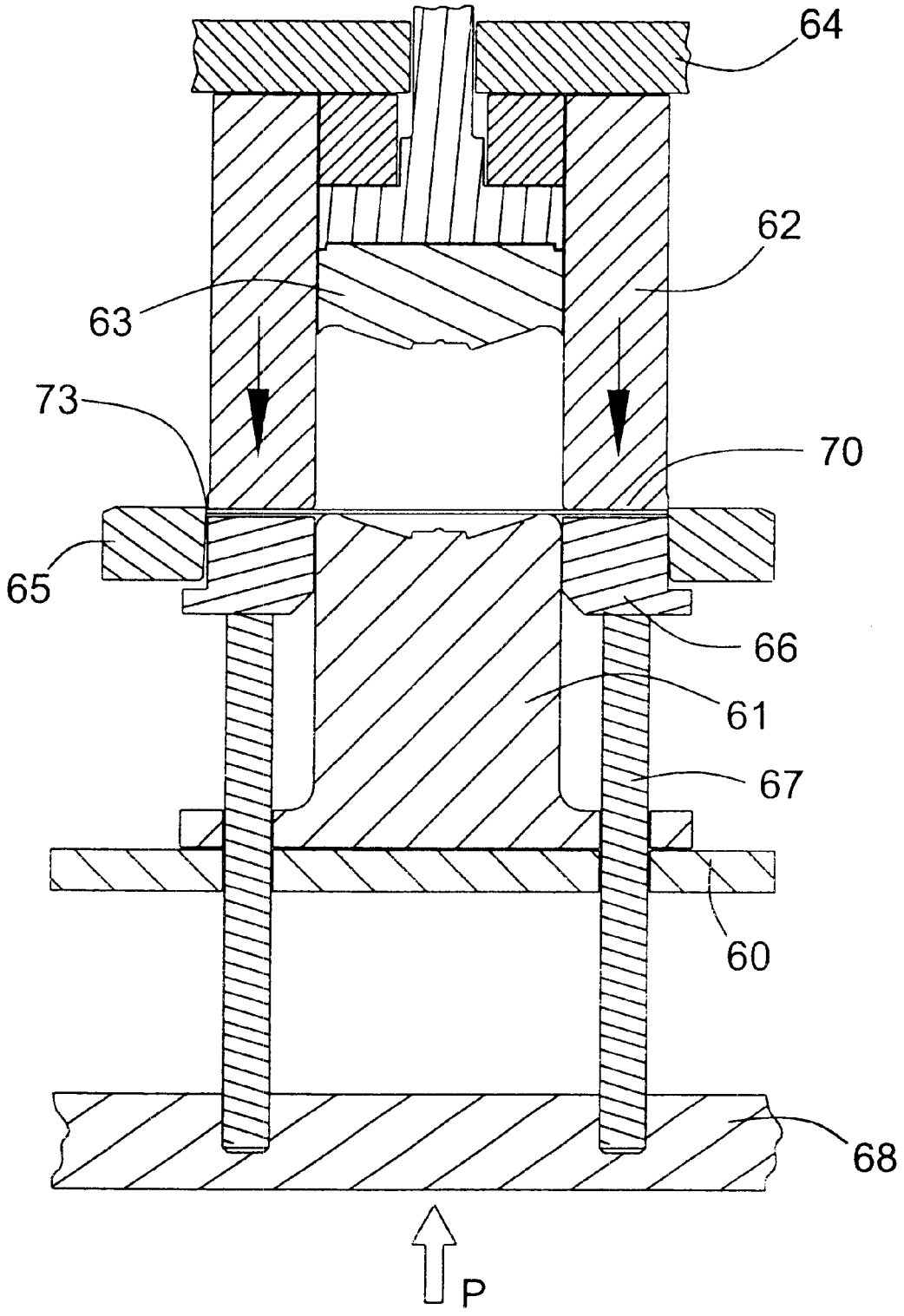

Returning to the basic configuration of the tool set, however, the punch member 62 cooperates with the driving member 64 to grip a metal blank 70 during the drawing operation. A draw ring 66 is mounted on rods 67 which are supported on a pin plate 68 loaded upwardly by a member represented by arrow P. Typically spring force, a nitrogen cylinder, or the like can exert a force against the pin plate 68 to yieldingly resist the advance of the punch while keeping controllable but significant pressure in the nip between the punch member 62 and the draw ring 66 to controllably restrain the blank during the drawing operation. A cutting ring 65 is fixed with respect to the bolster 60 so that the punch member 62 first cooperates with the cutting ring 65 to cut the circular blank of material. It will be seen that the material 70 is fed into the apparatus in the direction illustrated by the arrow 71. The material is fed through an automatic mechanism (not shown) until it clears the punch, whereupon the punch member 62 begins its downward cycle. The beginning of the downward stroke is shown in FIG. 6*b*. It will be seen that the punch member 62 has moved downwardly under the urging of the driving member 64, until the material 70 is gripped between the mating surfaces of the punch member 62 and the draw ring 66. The mating surfaces 73 between the exterior of the punch 62 and the cutting ring 65 serve to cut a cylindrical blank from the material. The punch 62 thereupon drives the draw ring 66 downwardly carrying the blank of material between them. Returning to the basic configuration of the tool set, however, the punch member 62 cooperates with the driving member 64 to grip a metal blank 70 during the drawing operation. A draw ring 66 is mounted on rods 67 which are supported on a pin plate 68 loaded upwardly by a member represented by arrow P. Typically spring force, a nitrogen cylinder, or the like can exert a force against the pin plate 68 to yieldingly resist the advance of the punch while keeping controllable but significant pressure in the nip between the punch member 62 and the draw ring 66 to controllably restrain the blank during the drawing operation. A cutting ring 65 is fixed with respect to the bolster 60 so that the punch member 62 first cooperates with the cutting ring 65 to cut the circular blank of material. It will be seen that the material 70 is fed into the apparatus in the direction illustrated by the arrow 71. The material is fed through an automatic mechanism (not shown) until it clears the punch, whereupon the punch member 62 begins its downward cycle. The beginning of the downward stroke is shown in FIG. 6*b*. It will be seen that the punch member 62 has moved downwardly under the urging of the driving member 64, until the material 70 is gripped between the mating surfaces of the punch member 62 and the draw ring 66. The mating surfaces 73 between the exterior of the punch 62 and the cutting ring 65 serve to cut a cylindrical blank from the material. The punch 62 thereupon drives the draw ring 66 downwardly carrying the blank of material between them.

Figure 6C:
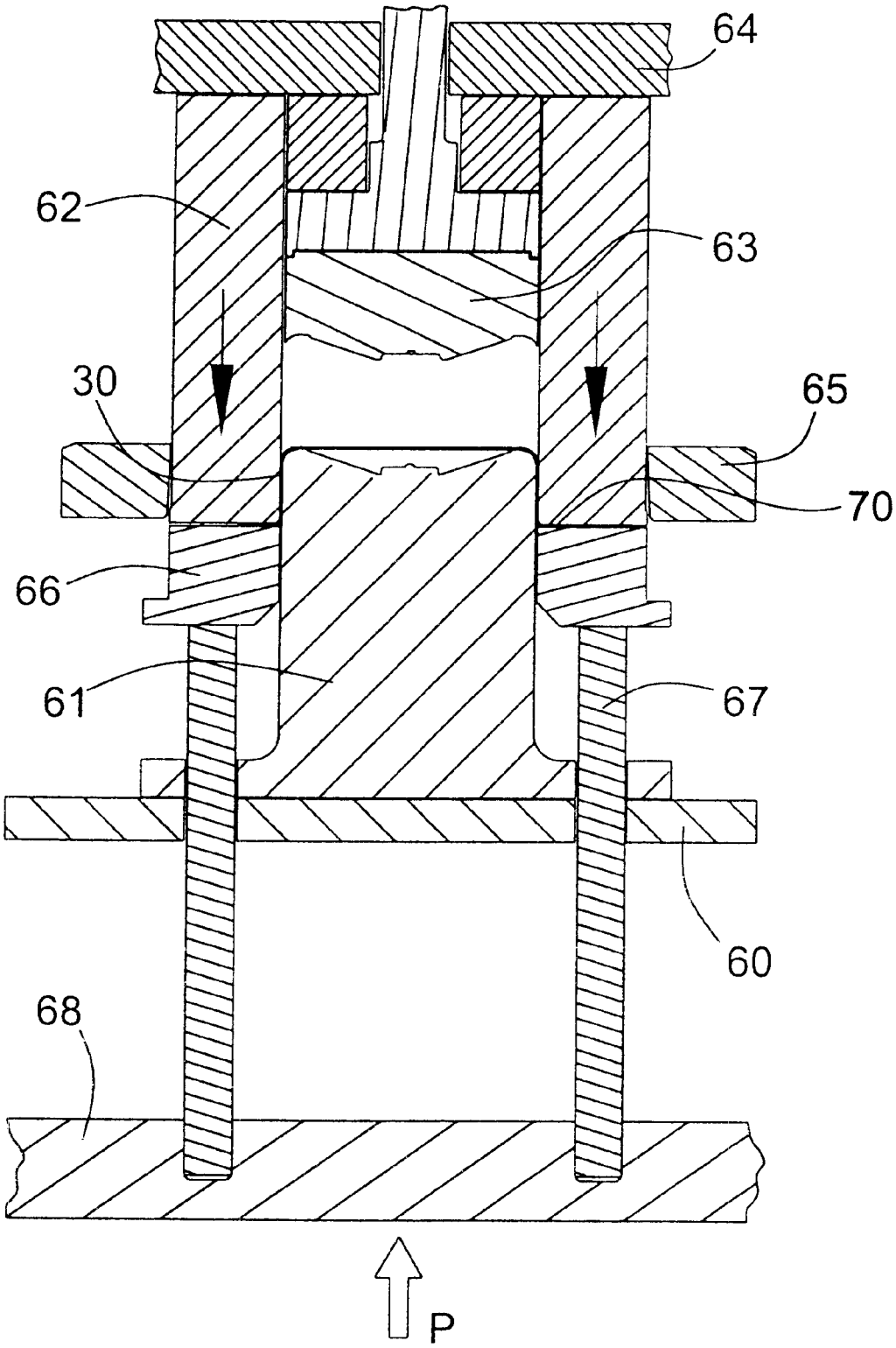

FIG. 6*c* shows the position of the elements of the tool set midway in the drawing process. It will be seen that a portion of the cylindrical sidewall 30 is formed, and continued downward motion of the punch member 62 and draw ring 66 continues to extrude material out of the nip between those elements to allow plastic flow of the metal around the external periphery of the center block 61 as drawing progresses.

Figure 6D:
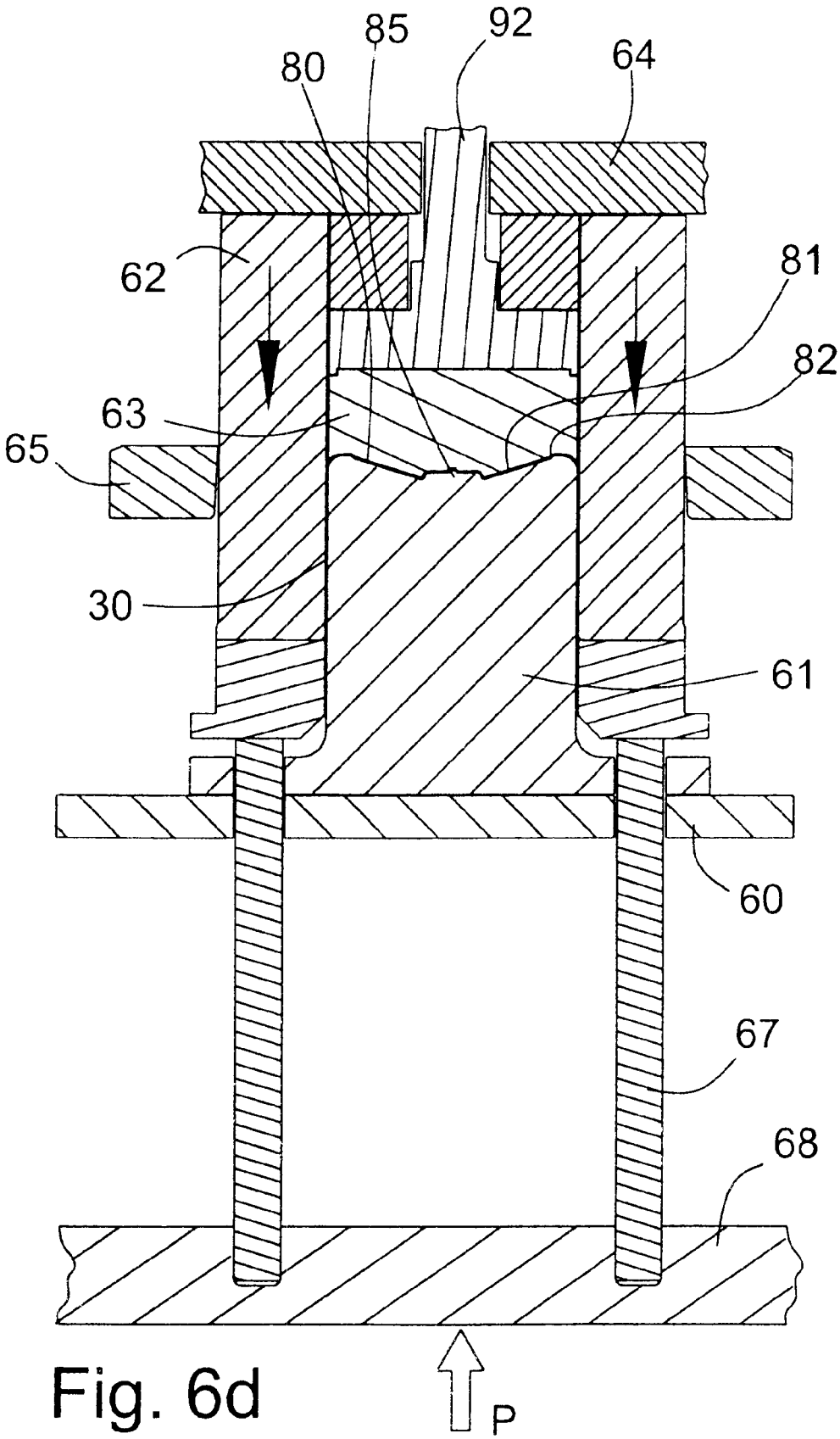
Figure 7:
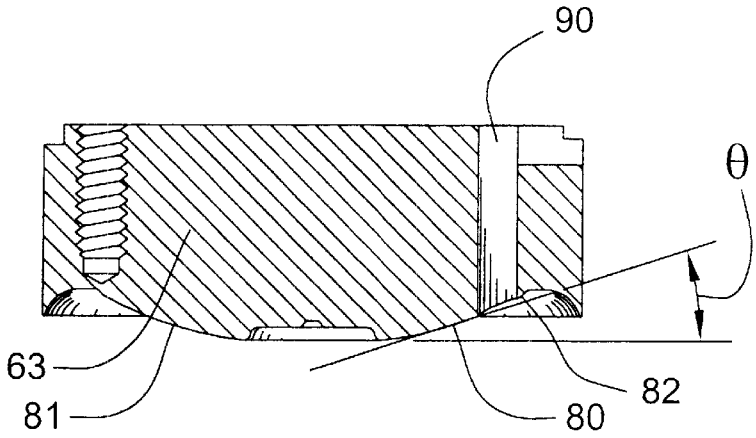
FIG. 7 is a cross-sectional view showing one of the change tool parts used in the tool set of FIG. 6*a–f*.

FIG. 6*d* then shows the formation of the bottom structure at the termination of the drawing stoke. The mating surfaces of the center block 61 and upper form pad 63 come into contact and shape the metal to the configuration defined by mating surfaces 80, 81 as indicated in FIG. 6*a* and FIG. 7. A description of the shape will not be repeated at this point, but is consistent with that described earlier in this specification. It will be noted, however, that whereas the cylindrical walls 30 were formed by plastic flow of the material controlled by the pressure between the punch and draw ring and the gap between the punch and center block, the shaping of the metal at the bottom of the can (the top as shown in FIG. 6*d*) is accomplished simply by deformation of the metal by the shaped faces of the center block and form pad, with the mechanism being stretching of the metal rather than plastic flow. The cooperating shapes of the facing surfaces 80, 81 of the center block and upper form pad include relatively gradual changes in shape to minimize substantial discontinuities, or the requirement to overstretch the material of the can bottom. Localized overstretching of the metal can gives rise to the possibility of cracks, tears or pinholes in the bottom of the container. In the preferred embodiment, the discontinuities are minimal and localized to the intended discontinuity 55 near the annular support surface 32, as is needed for the curling operation, and the less severe sidewall discontinuities 41 needed to form a lip of the dish shaped locating structure 27 for seating the wick holder 25.

At the completion of the stroke, the driving member 64 withdraws, and the thus-formed can is carried back within the punch 62 and is carried free of the center block 61. When the driving member 64 withdraws sufficiently, a knockout element 92 is actuated to drivingly move the piston associated with the knockout element 92 and the upper form pad 63 downwardly within the punch to eject the formed candle can. The material 70 advances into the die arrangement and the operation beginning with the cutting of a new blank shown in FIG. 6*a* is repeated. The apparatus is operated at a relatively high speed.

It will be appreciated that the candle can is thus formed with a relatively standard set of tool sets and only two "change parts". Change parts are parts of the tool set which are specially modified to the operation, which are to be used with conventional tool parts used for another operation. In the present embodiment, the only change parts are the center block 61 and the upper form pad 63.

Figure 8:
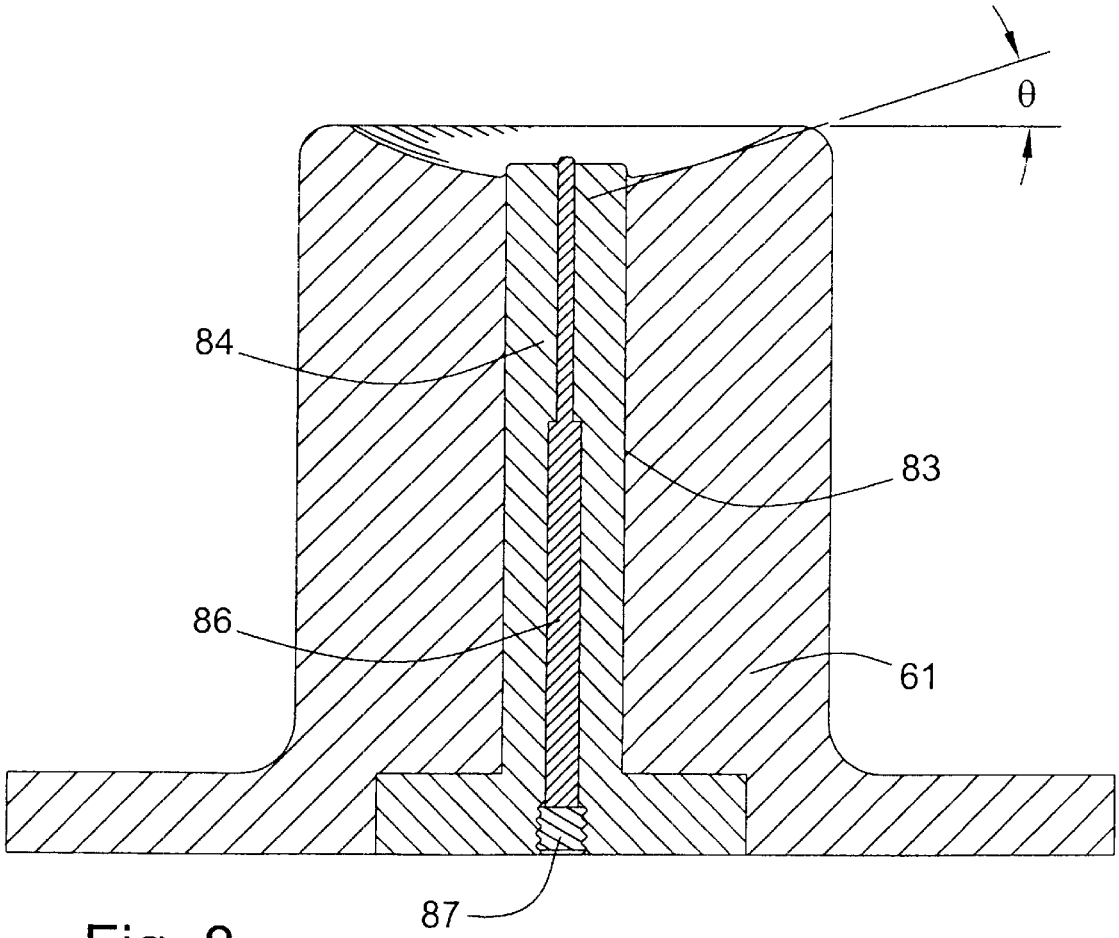
FIG. 8 is a cross-sectional view showing the other change tool part used in the tool set of FIG. 6*a–f*.

Attention is now directed to FIG. 8, which shows in cross-section the detailed internal structure of center block 61. This figure shows the center block surface configuration which forms the bottom cone shape dome surface in the bottom of the can. The outside periphery of the center block is made identically to the center block 61 used for forming a conventional can, and thus only the surface 80, need be specially configured. To reduce the cost of that configuration, the upper surface has only the tapered wall surfaces 81 and discontinuity 82 machined therein. In addition a center bore 83 is formed in the center block 61, and a rod 84 as shown is inserted into the center block 61, to provide the surfaces which form the cone shaped dome 26 of the finished can. In addition, to form the dimple 53 (FIG. 2) in the center of the platform, a hole is machined in the rod stock 84 and a small pin 85 inserted in the hole and held in position by a supporting rod 86 fixed in place by a fastener 87. While these details of construction are not essential to the operation of the invention, they illustrate the preferred form of economically making a change tool set to produce a candle can according to the present invention.

The upper form pad 63 (FIG. 7) is configured with the mirror image of the shape of the upper surface 80. It is typically machined as a unit, rather than made up as a composite structure as the center block. The machining operations are, however, relatively simple. In addition certain vent hole(s) 90 are provided in the upper form pad 63 to allow for the escape of air during the punching operation.

After the blank and draw operation, the cans are passed to a second machine whose function is to remove the excess material from the raw edge at the open end of the can, and to impart a slight inward curl to the upper edge of the cylindrical wall.

Figure 6E:
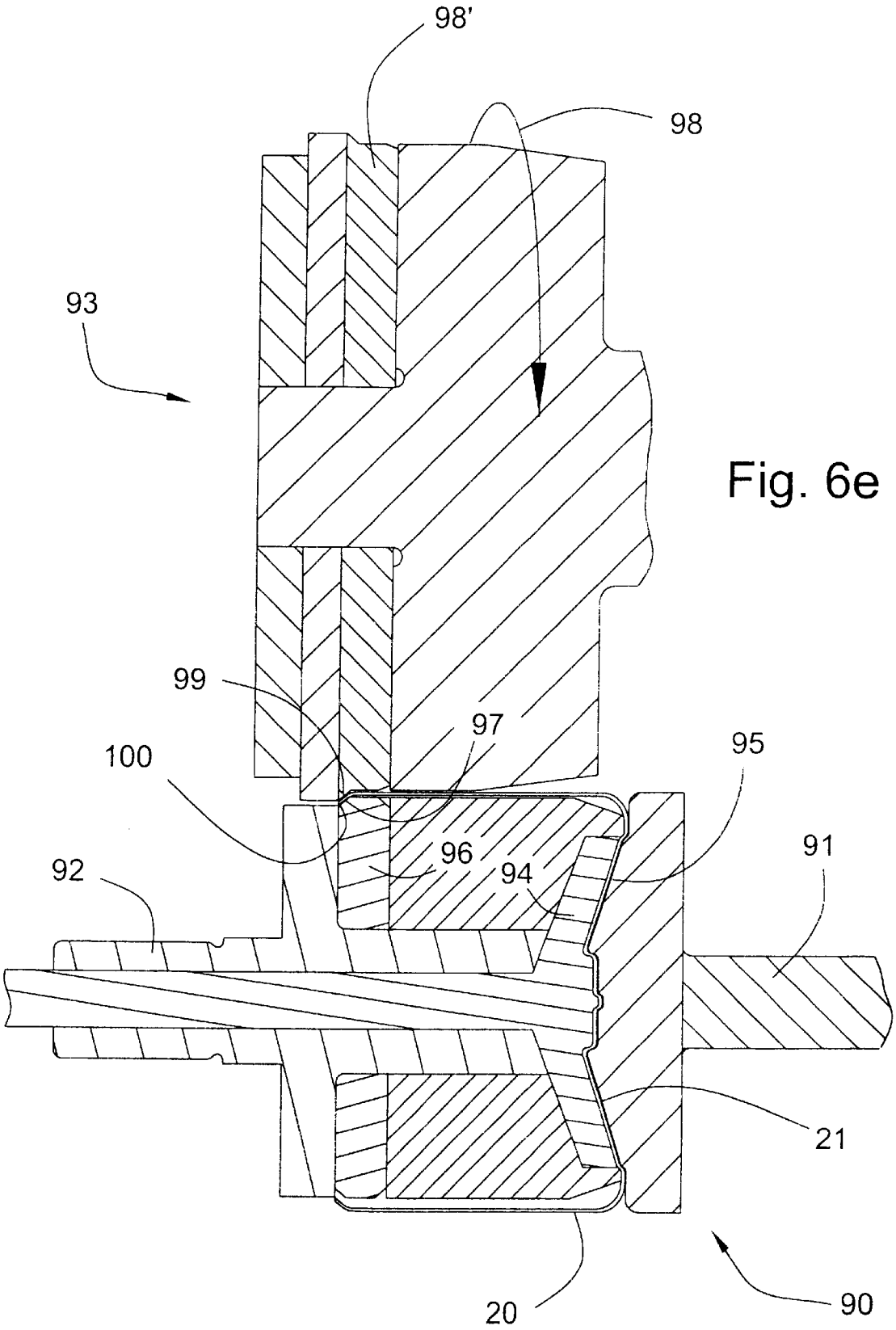

FIG. 6*e* schematically illustrates such an apparatus, particular forms of which are known to those skilled in the art. In the illustrated implementation, a rotatable anvil generally indicated at 90 including a rotatable center support a spindle 91 and an internal mandrel 92 support the can for rotational drive imparted by a knife assembly 93. The mandrel 92 is translatable along its axis, and in the illustrated position, a base 94 cooperates with the face 95 of the spindle 91 to clamp the bottom 21 of the can 20. An internal supporting ring 96, slightly smaller in diameter than the inside diameter of the can, has an edge 97 adapted to allow a slight inward curl of the can. The knife assembly 93 is rotatably driven by a motor (not shown) in the direction of arrow 98. The rotatable knife assembly carries a knife edge 99 which cooperates with the support ring 96 which serves as an anvil, to cut any excess material from the edge of the can, leaving a smooth edge, and to form a slight inward curl shown generally at 100. The motor drives the knife 99 which in turn drives the can to form and trim the edge. After formation and trimming, the mandrel 92 withdraws, allowing the can to fall away, and allowing the next can to be fed into position.

Figure 6F:
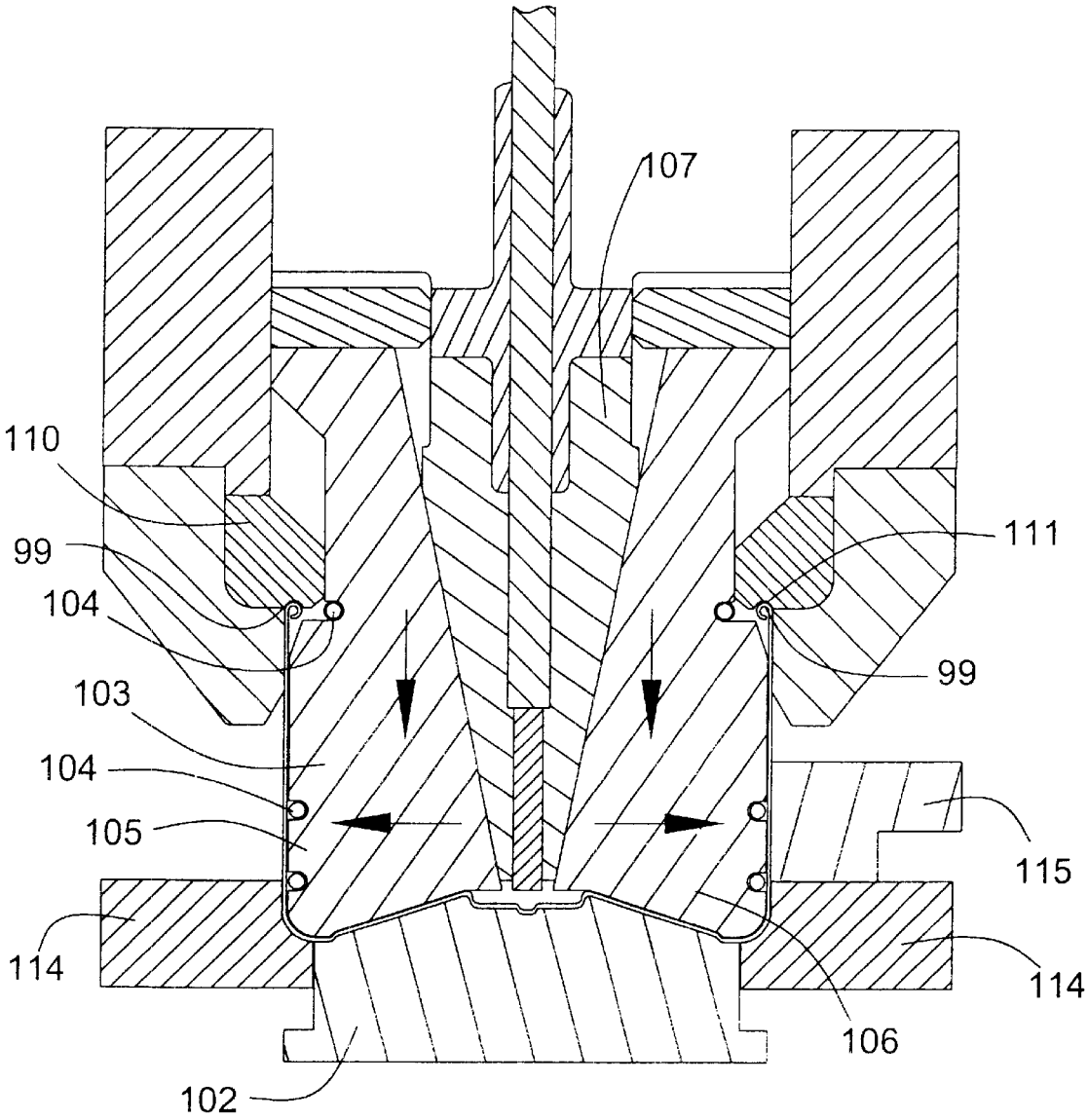

The curl is completed by a standard curl forming operation illustrated schematically in FIG. 6*f*. There is shown a support 102 for the lower portion of the formed can. A mandrel 103 is advanced downwardly until it occupies the inside of the can. The mandrel is of the expanding variety because it must hold the walls and structure of the can firmly during the curl forming operation then must withdraw from the can after the formed curl reduces the entrance diameter. The form of such expanding mandrels is well known and will not be described in detail. Suffice it to say that the mandrel includes a number of segments, two of which are illustrated at 105, 106 encircled by springs 104, which bias the segments to their retracted minimum diameter condition. A wedge 107 is axially slidable to drive downwardly and radially expand the segments to firmly support the container at the appropriate point in the cycle. After the mandrel is expanded as illustrated in FIG. 6*f*, a curl forming member, typically an annular die 110 having an annular groove 111, circular in cross section, moves downwardly with great force, engaging the partly inwardly curled lip, rolling the curl inwardly to complete the curl 99.

If the walls and structure of the candle can are not adequately supported during the curl forming operation, it will be found that the material "backs up" under the force of the curl forming die, potentially deforming the sidewalls or the bottom. In a conventional mandrel, the side walls are adequately supported by the sidewalls of the expanding mandrel and by opposed supporting members 114, 115 at the exterior of the can. Typically when the candle can has a planar bottom, and the mandrel has a flat surface in contact with that bottom, the material will not be inclined to back up into the area of the bottom, because it is adequately supported. However, the complex shape of the bottom according to the present invention presents certain unique considerations. If the bottom were not adequately supported, when the die blank engages the can to form the curl, it will attempt to drive the material of the cylindrical walls through the gripping section of the mandrel and ultimately to find an unsupported location on the bottom to actually back up the material into the bottom, rather than roll the top of the can.

In accordance with the invention, the discontinuity 55 (FIGS. 2–5) is intentionally formed in the bottom of the container, near the exterior periphery thereof, and the mandrel and base 102, 106 are configured to match that shape, so that the discontinuity is gripped when the mandrel and base are clamped together, preventing the sidewall from moving down to fill the bottom under the force imposed axially on the sidewall by the curl forming die. As a result, the formed candle can with complex bottom structure will be held in position while a tight curl 99 is formed at the top of the can.

After the curl is formed, the mandrel begins to withdraw, the springs 104 collapse the segments 105, 106, reducing the die diameter to allow its removal from the center of the can. The next can is fed into the machine and the procedure repeated. The cans are then ready for filling by the candle maker.

The candle maker simply arranges the can on a horizontal surface (which can be a movable surface in an automated apparatus), positions a wick with wick support, such as sustainer 25, on the seat 27 of the cone shaped dome 26, then fills the can with molten wax. When a dished seat is utilized, the wick support simply needs to be positioned with its base within the seat. Adhesive can be used if desired. When the flat-topped dome of FIG. 5 is utilized, it is preferable to utilize adhesive to secure the wick holder to the flat-topped portion of the dome. When the wax is poured, the wick will stay in position following which the poured wax solidifies. The candle is then packaged and ready for the consumer.

When the candle is burned, the wax moves up the wick by capillary action to fuel the flame as is conventional. When the candle burns down to near its end, the cone shaped dome aids in assuring extinguishment of the candle. At some point, before the pool is depleted, the pool will fall below the upper edge of the lip surrounding the dish shaped depression, and no further wax will be fed to the wick, which will ultimately cause the wick to extinguish. With a sustainer of about 5/16 inches, and a platform support of about 3/16 inches above the bottom, the candle will extinguish at a point in time where the flame is safely above the bottom of the can. This is intended to prevent flash-over. At the point where the candle is near extinguishment, the pool of wax has its primary volume at the outer periphery, the greatest distance possible from the flame. While the gentle taper of the walls of the cone shaped dome provides a less dramatic discontinuity than a pedestal, the benefits associated with that configuration outweigh the detriments. The fact of the reduction of the area of the can bottom in contact with the supporting surface, the minimization of waste candle wax in the candle, and the ability to form the candle can with a relatively conventional but modified blank and draw operation provides for high quality and economical production.

It should be readily apparent that the subject novel structure greatly enhance candle flame snuffing to prevent flash-over while simultaneously minimizing heat transmission and attendant scorching damage to any surface the can candle maybe placed. It should be appreciated that the subject invention provides for a reduction of the area of the can bottom in contact with the supporting surface the minimization of waste candle wax in the candle and the ability to burn the candle can with a relatively conventional but modified blank and draw operation that results in a high quality product and economy production.

What is claimed is:

1. A candle can deep drawn from a circular metal blank, the candle can comprising:

a deep drawn cylindrical sidewall connecting a closed bottom to an open top;

the closed bottom including a peripheral annular ring and a central dome, the annular ring merging into the cylindrical sidewall;

the central dome having a bottom wall surface and a mounting surface at the apex of the dome, the bottom wall surface joining the mounting surface to the annular ring, the intersection of the bottom wall surface and the mounting surface defining an annular edge, the mounting surface raised at least 3/16 inches above the annular ring to provide a seat for a wick sustainer;

the dome being constructed so that a line at an acute angle of between 15 and 60 degrees will intersect the annular edge and a plane that includes the annular ring; and whereby, when the can bottom is seated on a supporting surface, the majority of the bottom is spaced therefrom.

2. The candle can of claim 1, wherein the open top is provided with a curled peripheral edge, and the bottom wall surface of the dome joins the annular ring in a configuration including a gripping discontinuity for supporting the sidewall during the formation of the curl.

3. The candle can of claim 2, wherein the gripping discontinuity has an angle greater than the angle of the line.

4. The candle can of claim 2, wherein the gripping discontinuity is angled sharply relative to a plane through the annular ring.

5. The candle can of claim 4, wherein the gripping discontinuity provides a surface for providing direct resistance along the plane through the annular ring.

6. The candle can of claim 2, wherein the gripping discontinuity provides a surface for providing direct resistance along the line of the metal material.

7. The candle can of claim 2, wherein the gripping discontinuity includes a sharply bent but only slightly displaced annular notch defining a gripping surface near the bottom of the cylindrical wall for providing restraining support to the wall to resist the force imposed at the top of the wall when forming the top curl.

8. A unitary metal candle can structure of the type normally filled with an ignitable fuel, said candle can composed of:

a continuous vertically deep drawn sidewall that transitions through a stamped formed curved can wail region and into a stamped can base that includes an internal upwardly directed cone shaped dome having a mounting surface upon which a candle wick carrying element maybe securely located in an apex region of the cone shaped dome, the curved can wall region including an annular support surface for supporting the candle can on a surface, the cone shaped dome joining the annular support surface in a configuration including a gripping discontinuity that is sharply angled relative to the annular support surface.

9. The unitary metal can structure of claim 8, wherein the gripping discontinuity provides a surface for providing direct resistance along the plane through the annular ring.

10. The unitary metal can structure of claim 8 wherein the curved transition can wall region creates an annular support surface for the candle can base to thereby simultaneously establish annular internal volume of fuel separated by the cone shaped dome from a candle wick flame near the end of both the candle wick life and the supply of fuel which thereby minimizes flash-over while also creating an annular supporting surface for the candle can base to thereby reduce heat transfer from the candle fuel to a support surface.

* * * * *

UNITED STATES PATENT AND TRADEMARK OFFICE

CERTIFICATE OF CORRECTION

PATENT NO. : 6,648,631 B2
DATED : November 18, 2003
INVENTOR(S) : Chet Wright et al.

It is certified that error appears in the above-identified patent and that said Letters Patent is hereby corrected as shown below:

Column 12,
Line 42, delete the word “wail” and insert the word -- wall --.

Signed and Sealed this

Thirteenth Day of January, 2004

JON W. DUDAS
*Acting Director of the United States Patent and Trademark Office*